US005087045A

United States Patent [19]

Kim

[11] Patent Number: 5,087,045

[45] Date of Patent: Feb. 11, 1992

[54] PUTTING GREEN WITH ADJUSTABLE TOPOGRAPHY AND MULTI-BALL RETURN

[76] Inventor: Samuel Kim, 3820 Charlemagne Dr., Hoffman Estates, Ill. 60195

[21] Appl. No.: 485,296

[22] Filed: Feb. 26, 1990

[51] Int. Cl.[5] ..... A63B 67/02

[52] U.S. Cl. ..... 273/176 H

[58] Field of Search ..... 273/176 H, 34 R, 34 A, 273/183 A, 176 R

[56] References Cited

U.S. PATENT DOCUMENTS

| | | | |
|---|---|---|---|
| 2,678,823 | 5/1954 | Hugman | 273/176 H |
| 3,366,388 | 1/1968 | Del Raso . | |
| 3,508,756 | 4/1970 | Bedford . | |
| 3,522,947 | 8/1970 | Anderson et al. | 273/176 H |
| 3,580,583 | 5/1971 | Gentiluomo | 273/176 H |
| 3,595,581 | 7/1971 | Anderson et al. | 273/176 H |
| 3,601,407 | 8/1971 | Lorrance . | |
| 3,658,343 | 4/1972 | Rogers et al. | 273/176 H |
| 3,690,673 | 9/1972 | Occhipinti | 273/176 H |
| 3,727,917 | 4/1973 | Maclean . | |
| 3,762,718 | 10/1973 | Culleny . | |
| 3,831,949 | 8/1974 | Henning . | |
| 3,871,650 | 3/1975 | Casey | 273/176 H |
| 4,202,547 | 5/1980 | Mueller | 273/176 H |
| 4,222,568 | 9/1980 | Russo . | |
| 4,240,637 | 12/1980 | Cross et al. . | |
| 4,247,112 | 1/1981 | Del Raso | 273/176 H |
| 4,611,809 | 9/1986 | Gettlefinger . | |
| 4,790,538 | 12/1988 | Gettlefinger . | |

*Primary Examiner*—Theatrice Brown

*Attorney, Agent, or Firm*—Laff, Whitesel, Conte & Saret

[57] ABSTRACT

A putting green assembly, the assembly comprising a playing mat, a ball cup and a combination means for adjusting the topography of the green and for returning a plurality of balls, the combination means being adapted to elevate at least one flattened area of the playing mat and create an incline therein, the incline changing the topography of the playing mat and further causing the plurality of balls to move away from the incline of the playing mat.

4 Claims, 6 Drawing Sheets

| COMBINATION NUMBER | ACTUATOR POSITIONS 374 | 378 | 382 | 386 | 390 |
|---|---|---|---|---|---|
| 1 | N | N | N | N | N |
| 2 | E | N | N | N | N |
| 3 | N | E | N | N | N |
| 4 | E | E | N | N | N |
| 5 | N | N | E | N | N |
| 6 | N | N | N | E | N |
| 7 | N | N | E | E | N |
| 8 | E | N | E | N | N |
| 9 | N | E | E | N | N |
| 10 | E | E | E | N | N |
| 11 | E | N | N | E | N |
| 12 | N | E | N | E | N |
| 13 | E | E | N | E | N |
| 14 | E | N | E | E | N |
| 15 | N | E | E | E | N |
| 16 | E | E | E | E | N |
| 17 | E | E | N | N | E |
| 18 | E | N | N | N | E |
| 19 | N | N | N | N | E |
FIG. 13
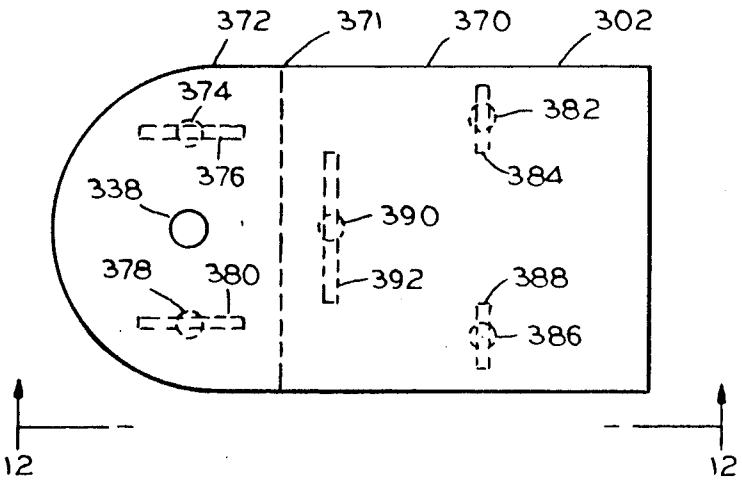
FIG. 11
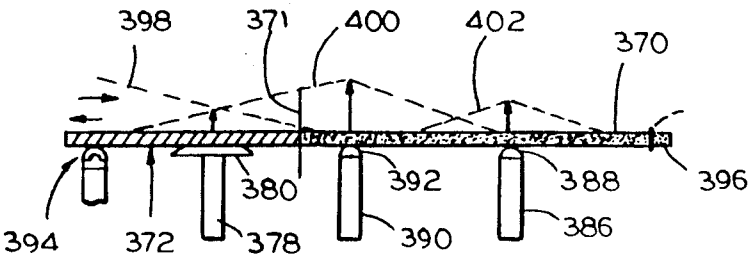
FIG. 12

PUTTING GREEN WITH ADJUSTABLE TOPOGRAPHY AND MULTI-BALL RETURN

FIELD OF THE INVENTION

This invention relates to a putting green for golfers. More particularly, this invention relates to a putting green assembly for golfers that includes an adjustable topography and multi-ball return mechanism.

BACKGROUND OF THE INVENTION

A variety of putting greens for golfers are known. These putting greens may be portable, as, for example, the greens often found in homes or offices, or these putting greens may be stationary or permanently fixed to an area, such as the greens found in amusement parks or game rooms. Regardless of whether these prior art putting greens are portable or stationary, they basically are similar in their structure and mode of operation. For example, the existing portable and stationary greens have stationary slopes. Thus, the area or slope surrounding the ball cup always remains constant and may not be adjusted for slope variation. Furthermore, most existing portable and stationary greens usually require the golfer to retrieve putted balls from the cup or the area surrounding the cup. While some of the existing greens include a ball retrieval mechanism, these mechanisms usually involve systems which only remove the balls found in the cup, and not in the area surrounding the cup. In some cases, these ball-in-the-cup retrieval mechanisms do not operate to return the putted ball to the golfer, but instead, the balls are returned to a holding box as a theft preventative measure. Such holding boxes are typically found in amusement parks or game rooms.

Thus, while the existing portable and stationary putting greens offer the golfer the basic essentials—a green with a single slope and a cup for the ball—they are extremely limited in their structure and operation.

Accordingly, an object of the present invention is to provide a putting green assembly having a manually or automatically adjustable slope.

Another object of the present invention is to provide a putting green assembly having a manual or automatic multiball return mechanism.

Another object of the present invention is to provide a putting green assembly in which the area of the green surrounding the cup need not have an upward slope to accommodate the depth of the cup.

Another object of the present invention is to provide a putting green assembly that may include an extension mat for chipping.

Another object of the present invention is to provide a putting green assembly which may be portable or stationary.

A further object of the present invention is to provide a putting green assembly which may be used indoors or outdoors.

A further object of the present invention is to provide a putting green assembly that is inexpensive to manufacture.

SUMMARY OF THE INVENTION

The present invention accomplishes the foregoing objects by providing a putting green assembly comprising, in part, an adjustable slope and multi-ball return mechanism. In a first embodiment, the putting green assembly comprises a combination slope elevation mechanism and a multi-ball return mechanism which is operated manually. This combination slope elevation and multi-ball return mechanism is elevated above and straddles the green at that end of the green where the cup is located. The combination mechanism is attached to the green at various locations by nylon or other rope material. The slope of the green is changed by adjusting the nylon or other rope material at certain points. Likewise, the balls lying around or inside the cup are returned by pulling a specific nylon rope on the combination mechanism.

A second embodiment of the putting green assembly according to the present invention is generally similar in concept to the putting green of the first embodiment, but in addition provides automated playing surface elevation, ball return, and scoring and is therefore more suitable for use in sophistocated applications including, for example, a public game arcade or the home or office of an avid golfer.

Thus, the present invention provides, in all of the embodiments, a structure for a putting green that includes an adjustable slope and a multi-ball return mechanism. In the first embodiment, the slope is adjusted and the balls are returned manually and in the second embodiment, the same result is accomplished through automation.

The above, as well as other object and advantages of the invention, will become apparent from the following detailed description of the preferred embodiment, reference being made to the accompanying drawings.

BRIEF DESCRIPTION OF THE DRAWINGS

FIG. 11 is a top plan view of the playing surface of the putting green of FIG. 10.

FIG. 12 is a side elevation view of the playing surface and elevation apparatus, as taken along lines 12—12 of FIG. 11.

FIG. 13 is a table illustrating the various positions of the playing surface shown in FIGS. 10–12.

DETAILED DESCRIPTION OF THE INVENTION

Figure 1:
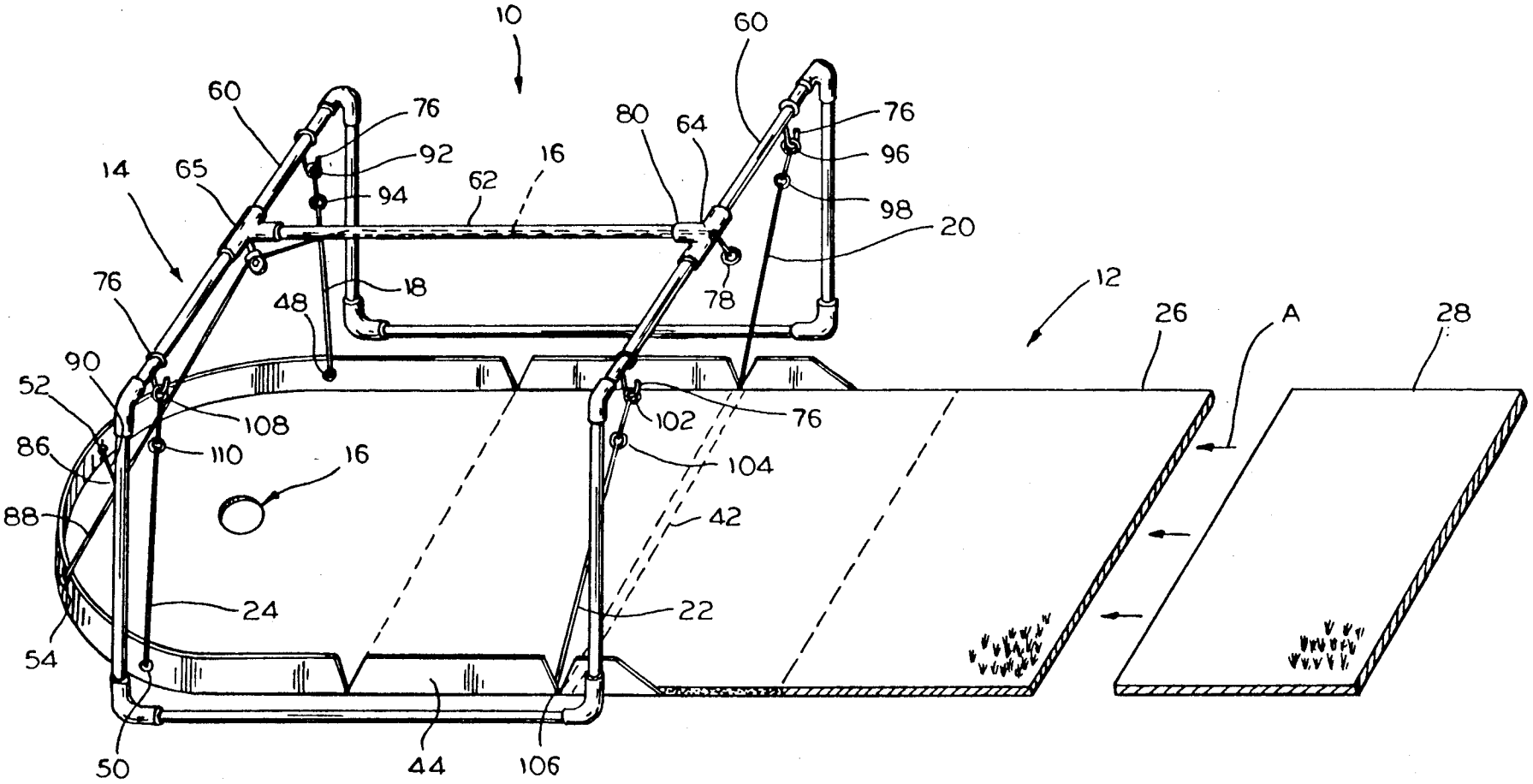
FIG. 1 is a perspective view of a first embodiment of the inventive putting green assembly.

Referring first to the embodiment shown in FIG. 1, a putting green assembly is generally denoted by the numeral 10, and includes, in part, an elongated putting green or playing surface 12, a combination slope-elevation and multiball retrieval mechanism or means 14 and ball cup 16. Nylon or rope members 16, 18, 20, 22 and 24 extend from mechanism 14 to playing surface 12 and enable a player to manually adjust the elevation and topography of playing surface 12.

Figure 2:
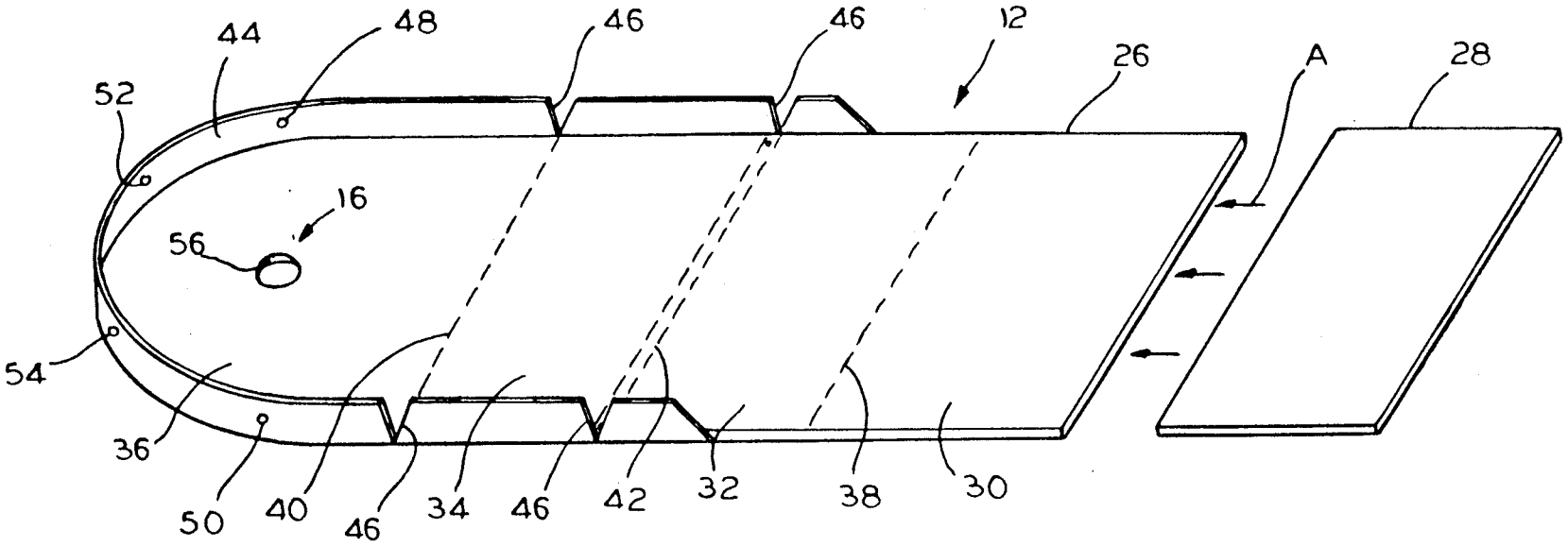
FIG. 2 is a perspective view of the playing surface of the inventive putting green assembly of FIG. 1.

Referring to FIG. 2, playing surface 12 generally comprises two main sections 26 and 28. Section 26 is approximately nine feet in length and three feet in width. Section 28 is approximately three feet in length and two feet in width. Both section 26 and 28 are approximately ¾" to 1 inch in thickness which thickness comprises a backing material covered by an artifical grass carpet.

Section 26 includes four foldable subsections 30, 32, 34 and 36. Subsection 30 and subsection 32 are separated by a first perforation 38 which extends across the width of playing surface 12. Subsection 34 and subsection 36 are separated by a second perforation 40 which also extends across the width of playing surface 12. Subsection 32 and subsection 34 are separated by a metal plate strip 42, which will be discussed in greater detail later.

Section 26 further includes a plastic pan or ridge 44 which extends upwardly a distance of two to four inches and partially around the perimeter of section 26. Ridge 44 includes a plurality of breaks 46 which are located at each end of second perforation 40 and metal plate strip 42. Breaks 46 allow for subsection 32, 34 and 36 to move relative to each other. Ridge 44 further includes holes 48, 50, 52 and 54.

Section 26 also includes ball cup 16 which is located in approximately the center of subsection 36.

Section 28 may be attached to section 26 when needed, as indicated by the arrows A in FIGS. 1 and 2, and serves as an extension mat. Section 28 is generally used as a chipping mat.

Subsections 32, 34 and 36 include a flexible sponge backing beneath the overlying artificial grass carpet. Subsection 30 of section 26 and section 28 each include a hard styrofoam backing beneath the overlying artificial grass carpet.

Figure 3:
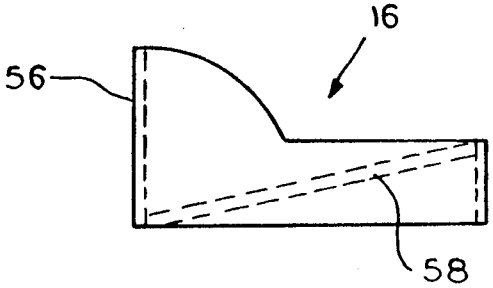
FIG. 3 is a perspective view of the combination slope-elevation and multi-ball retrieval mechanism of the inventive putting green assembly of FIG. 1.

Ball cup 16, as illustrated in FIGS. 1-3, is circular and has approximately a 4⅛ inch diameter. Ball cup 16 is positioned approximately at midcenter of subsection 36 of section 26. Ball cup 16 includes a rim 56 which extends around approximately one-half of the circumference of cup 16. Rim 56 extends above the surface of subsection 36 a distance of approximately one inch. The bottom 58 of cup 16 is inclined, with its lowest point intersecting that portion of cup 16 which is adjacent to rim 56. Rim 56, in conjunction with the inclined bottom 58 of cup 16, effectively retains a ball which enters the cup.

Figure 4:
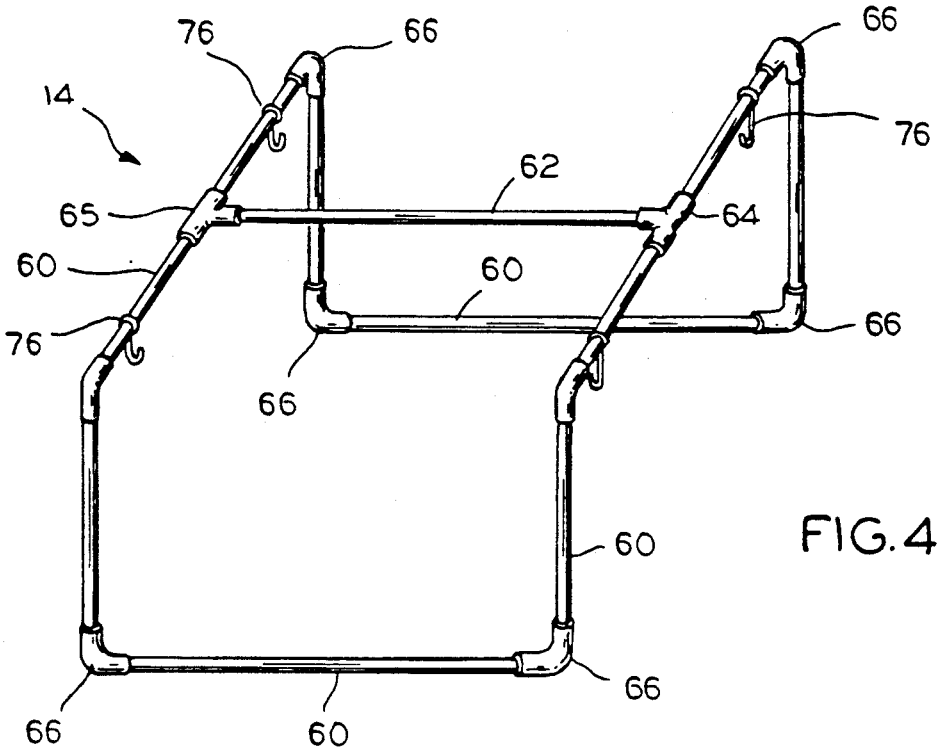
FIG. 4 is a side view of a the ball cup illustrated in FIG. 1.
Figure 7:
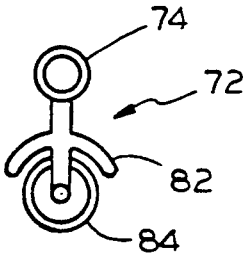
FIG. 7 is a plan view of a roller which is attached to the T-joint illustrated in FIG. 6.

Referring to FIG. 4, slope elevation and multi-ball retrieval mechanism 14 generally comprises a structure that involves connecting a plurality of pipes 60, 62, such as poly-vinyl chloride (PVC) piping, by various connecting means, as for example, T-joints 64, 65 and elbow joints 66. Both T-joints 64 and 65 include openings, 68 and 70, respectively, which are for use in the operation of mechanism 14. T-joint 65 further includes a roller 72 (see FIG. 7) which is attached to T-joint 65 through openings 70 by ring 74.

Figure 8:
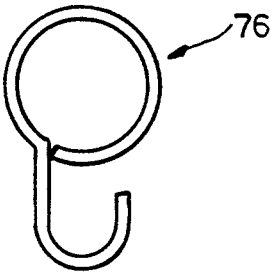
FIG. 8 is a plan view of an o-ring with hooked projection used to adjust the elevation of the putting green assembly shown in FIG. 1.

Mechanism 14 further includes a plurality of o-rings with hooked projections 76 (see FIGS. 4 and 8) which are located on upper pipes 60. These hooked rings 76 will be described in more detail later.

As previously mentioned and as shown in FIG. 1, mechanism 14 is positioned above cup 16 of subsection 36 of section 26. Mechanism 14 is attached to section 26 at numerous locations by nylon members 16, 18, 20, 22 and 24.

Figure 5:
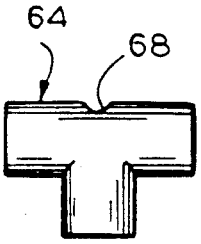
FIG. 5 is a plan view of a T-joint used to secure the piping of the combination slope-elevation and multi-ball retrieval mechanism of FIG. 1.
Figure 6:
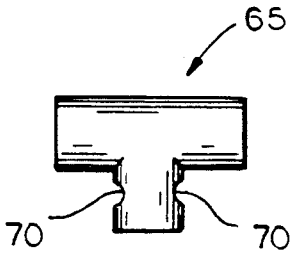
FIG. 6 is a plan view of an elbow joint used to secure the piping of the combination slope-elevation and multi-ball retrieval mechanism of FIG. 1.

Nylon member 16 is secured to mechanism 14 at T-valve 64, as shown in FIG. 1. A first ring 78 is attached to the one end of nylon member 16. Nylon member 16 passes into T-valve 64 through opening 68 (see FIG. 5) and then passes out of T-valve 64 at point 80. Nylon member 16 extends in parallel relationship to pipe 62 until it reaches roller 72, whereupon nylon member 16 is threaded between roller shield 82 and rotating wheel 84 (see FIG. 7). Nylon member 16 extends away from roller 72 whereupon it splits at point 86 and forms a forked section made up of segments 88 and 90. Segments 88 and 90 extend through openings 50 and 52 of ridge 44.

Figure 9:
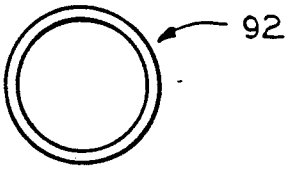
FIG. 9 is a plan view of an o-ring used to adjust the elevation of the putting green assembly of FIG. 1.

Nylon members 18, 20, 22 and 24 each extend downwardly from pipe 60 to section 26 of playing surface 12. Nylon member 18 includes a first o-ring 92 at its on end which is attached to pipe 60 at hooked ring 76. Nylon member 18 includes a second o-ring 94 which is positioned immediately below first o-ring 92 (see FIG. 9). Nylon member 18 extends downwardly whereupon it attaches to ridge 44 through opening 48.

Nylon members 20, 22 and 24 are attached in the same manner as nylon member 18. Nylon member 20 includes a first o-ring 96 at its one end which is attached to pipe 60 at hooked ring 76. Nylon member 20 includes a second o-ring 98 below the first o-ring 96. Nylon member 20 is attached to metal plate strip 92 through an opening 100.

Nylon member 22 has a first o-ring 102 which is attached to hooked ring 76. A second o-ring is positioned immediately below. Nylon member 22 is attached to metal strip 42 through an opening 106.

Nylon member 24 has first o-ring 108 which is attached to hooked ring 76. A second o-ring 110 is positioned immediately below. Nylon member 24 is attached to ridge 44 through opening 50.

The elevation and slope adjustment of playing surface 12 is effectuated by adjusting the length of nylon members 18, 20, 22 and 24, which is accomplished by either hooking the first o-ring or the second o-ring of any of the nylon members onto hooked ring 76. For example, one of the numerous slopes may be formed by attaching nylon member 18 to hooked ring 76 by second o-ring 94, and then attaching nylon members 20, 22 and 24 to hooked ring 76 by first o-ring 96, 102 and 108, respectively. Then, to create a different slope from the above slope configuration, one may change the above configuration, for example, by simply placing second o-ring 110 of nylon member 24 onto hooked ring 76. The nylon members may be adjusted in this manner to create sixteen different slopes for playing surface 12. The first and second perforations, 38 and 40, respectively, and metal strips 42, allow playing surface 26 to be elevated by nylon members 20 and 22.

To retrieve a ball from ball cup 16 or from the area surrounding cup 16, a golfer simply pulls ring 78. As previously mentioned, ring 78 is attached to nylon member 16 which is in turn attached to ridge 44 of section 26. Thus, when ring 78 is pulled, section 26 is bends slightly along second perforation 40 and metal strip 42 and then moves upwardly. The incline created by pulling ring 78 causes any balls to roll away from cup 16 and towards subsection 30 at the other end of playing mat 26. Since cup 16 includes a sloped bottom 58, any ball inside of cup 16 also will easily roll out once playing mat 12 is inclined. After the balls have been cleared from that portion of section 26 under retrieval mechanism 14, ring 78 is released by the golfer to lower section 26 to its normal flattened elevation.

A second embodiment of a putting green 300 according to the present invention is shown in FIGS. 10-14. This putting green is generally similar in concept to the putting green of FIG. 1, but in addition provides automated playing surface elevation, ball return, and scoring and is therefore more suitable for use in sophistocated applications including, for example, a public game arcade or the home or office of an avid golfer.

Figure 10:
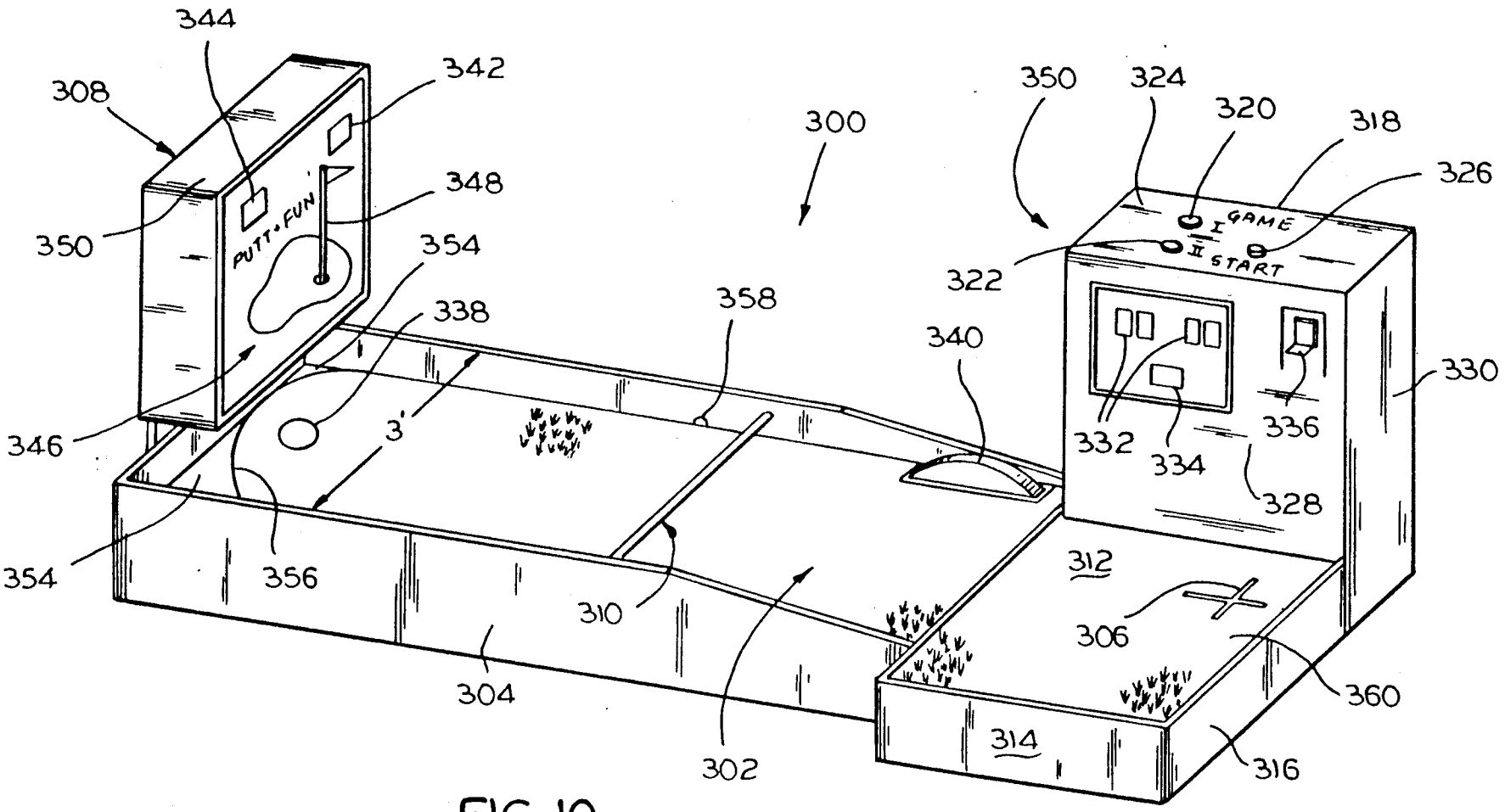
FIG. 10 is a perspective view of a second embodiment of a putting green according to the present invention.

Referring now to FIG. 10, there is shown a perspective view of the automated putting green 300. The putting green has a playing surface 302, a player platform 312, a score and information display 308, and a control station 350 which may optionally include payment receiving means 332. The playing surface 302 is a substantially rectangular area disposed parallel to a supporting floor surface (not shown) and raised a nominal distance thereover to permit the housing of certain mechanical components of the putting green between the playing surface and the floor. A plurality of wall members 304 support the playing surface 302 on the floor and define an enclosure to protect the mechanical components from tampering and damage due to foreign materials such as dust and rubbish. The wall members 304 extend above the playing surface 302 several inches to prevent golf balls which reach the boundary of the playing surface from dropping onto the floor.

A transparent semi-rigid window 310, several inches above and substantially parallel to the playing surface 302, extends from the rearmost portion of the playing surface to a position near the front of the playing surface. The window cooperates with the enclosure wall members 304 to prevent balls hit with excessive force from bouncing out of the putting green 300, and to prevent players from cheating by manually moving a ball once it has been played. The window 310 is preferably constructed from an appropriate shatter resistant transparent sheet material, such as acrylic or polycarbonate.

The playing surface 302 is preferably covered with a carpet of artificial grass or other appropriate covering to simulate the "green" area found near the "hole" on a golf course. The playing surface 302 is flexible and divided into a number of sections (FIG. 11) which may be displaced vertically a small distance from their nominal (flat) positions to create, in combination, a the simulated topography of an actual golf-course green.

The playing surface 302 contains a hole 338 located near its rear extremity to serve as a target for putted balls. An automatic ball return means 340 is provided near the front of surface 302 to provide, at appropriate times, a new golf ball for a player to use. A gutter channel (not shown) is located beneath playing surface 302 and extends, in part, from the hole 338 to the automatic ball return means 340 so that golf balls which successfully reach the hole 338 may be recycled for further use. The playing surface 302 has a rounded rear edge 356 which, in combination with planar wall members 304 define interstitial ball return openings 354. Some balls which overshoot the target hole 338 fall into these openings of their own accord. Other balls which come to rest on the playing surface 302 without reaching target hole 338 may be urged into these openings 354 via the automatic playing surface elevation means to be discussed in detail in a later section. Balls which enter these openings 354 are returned via the gutter channel which additionally extends beneath playing surface 302 from these openings to the automatic ball return means 340. The automated ball return means 340 preferably includes a reservoir capable of retaining a plurality of balls so that more than one ball may be present on the playing surface at a particular time.

The player platform 312 is located adjacent the front end of the playing surface 302 and provides a location for the player to stand while making a putt. The top surface 360 of the player platform is preferably flush with the playing surface 302 and is covered with a similar artificial grass carpet so that balls putted will roll smoothly from the player platform top surface 360 to the playing surface 302. A launching area or "tee" 306 is marked on the top surface 360 to indicate the proper ball position. The top surface 360 is supported by front and side wall members 316, 314 and by additional supports as needed to accommodate the weight of players.

A control station 350 is provided adjacent the player platform 312 to allow the player to control the operation of the game. The control station 350 may be a rectangular box structure including front wall 330, side wall 328, and top wall 324. Appropriate control actuators are preferably provided on at least one of these walls to allow the player to select a scoring method or set of game rules and to commence play. For example, push-buttons 320, 322, and 326 are shown on top wall 324, which push-buttons are preferably electrically connected to an appropriate, control means (FIG. 14) for controlling operation of the mechanical game functions. Suitable legend or instructional material 318 is preferably displayed on top wall 324 to indicate the function of these switches 320, 322, 326.

If the putting green 300 is used in a public place, such as a game arcade, it may be desired to collect payment from the players. Accordingly, control station 350 may additionally comprise payment receiving means, including a currency acceptor 336, and coin or token receiving slots 332. A coin or token return slot 334 is also provided for rejecting coins which are defective or counterfeit or for providing change should a player overpay. The currency acceptor 336, coin/token receiving slots 332, and coin/token return slot 334 are preferably electrically connected to control means 420 (FIG. 14) so that balls may be withheld, or other appropriate action may be taken to prevent play by users who have not paid the requisite fee.

The score and information display 308 is located above the rear end of the playing surface 302 for providing the current score and other game related information, such as the number of balls left to play, or the player number in a multiple player game, to the players. The display 308 includes a front panel 346 disposed substantially perpendicular to the playing surface 302 facing the player platform 312, and is preferably plainly visible to the players and passers by. The front panel 346 includes first and second score displays 342, 344 to indicate the score for each player. The front panel preferably also includes lighted pictorial material 348 for enticing passersby to play the game.

Referring now to FIGS. 11-13, there is shown automated means for adjusting the elevation of sections of the playing surface 302 thereby modifying the topography of the green. FIG. 11 is a top plan view of the playing surface 302 showing the underlying mechanical components in dotted lines. FIG. 12 is a side view of the playing surface 302 from lines 12—12 of FIG. 11. The playing surface 302 is divided into two structural sections: a flexible section 370 and a rigid section 372, which sections are securely joined at line 371. The flexible section 370 is preferably contstructed from a sheet of an appropriate cloth, rubber, or vinyl material. The rigid section 372 is preferably constructed from an appropriate rigid structural material, such as wood, plywood or sheet metal.

The flexible section 370 of playing surface is fixedly attached at its front end by holding means 396 to a component of a front wall member (not shown) so that it may not move either vertically or horizontally. The rigid section 372 is supported at its rear end by a roller 394, but is not attached to the roller, so that it may move vertically. A set of five elevation bearing means 376, 380, 384, 388, 392 are disposed under the playing surface 302 in approximate corner positions and an approximate center position, thereof for supporting and elevating a segment of the playing surface 302 surrounding each bearing means 376, 380, 384, 388, and 392. Bearing means 376, 380, 384, 388 and 392 rest on a set of five playing surface segment elevation actuators 374, 378, 382, 386, and 390 respectively which control the vertical positions of the bearing means. The actuators 374, 378, 382, 386 and 390 are preferably electrically controlled and operated and may each independently assume a normal position as shown in FIG. 12 or an elevated position. When in the elevated positions, each actuator raises its respective bearing means a nominal distance of approximately 2-4 inches.

Since the playing surface 302 rests on and is supported by the bearing means 376, 380, 384, 388 and 392, elevating the bearing means will elevate a surrounding segment of the playing surface. This is shown in FIG. 12 where dotted lines 398, 400, and 402 indicate the profile of the playing surface 302 when bearing means 380, 392, and 388 are respectively elevated. Since bearing means 384, 388, and 392 are disposed under the flexible section 370 of playing surface 302, a convex hill is formed about these bearing means when they are elevated. In contrast, bearing means 376 and 380 are disposed under the rigid section 372 of playing surface 302. Since the rear end of section 372 is free to move vertically, when these bearing means 376, 380 are raised, rigid section 372 assumes an angular incline as shown by line 398.

The bearing means 376, 380, 384, 388 and 392 are substantially bar shaped and have a curved upper surface so that the hills formed thereby ar relatively gentle. In addition, the curved upper surface of the bearing means prevents damage to the playing surface 302.

Because each actuator 374, 378, 382, 386, and 390 may be independently controlled, different combinations of normal and elevated actuators create a large number of potential green topographies, thereby providing variety and challenge to the players. FIG. 13 lists a number of combinations of actuator positions which produce useful green topographies. Each column represents the position of one of the actuators 374, 378, 382, 386, and 390 respectively. Each row represents a particular combination of actuator positions. An "E" in the table indicates that the corresponding actuator is elevated, and an "N" in the table indicated that the corresponding actuator is in its normal position. Thus, in row 11, actuators 374 and 380 are in their elevated positions, and actuators 378, 382, and 390 are in their normal positions. This combination would result in an incline in the rear right corner of the playing field 302 corresponding to actuator 374, and a hill in the front left corner of the playing field 388.

Row 19 of FIG. 13, representing the case where only actuator 390 is elevated, is of particular interest. In this this position any balls which have come to rest on the playing surface 302 will either roll toward the rear of the playing surface and fall into ball return openings 354 for collection, or will roll out to the player platform 312 for reuse. Thus, all balls on the playing surface 302 may be collected automatically by setting the playing surface to conform to row 19 of FIG. 13.

Figure 14:
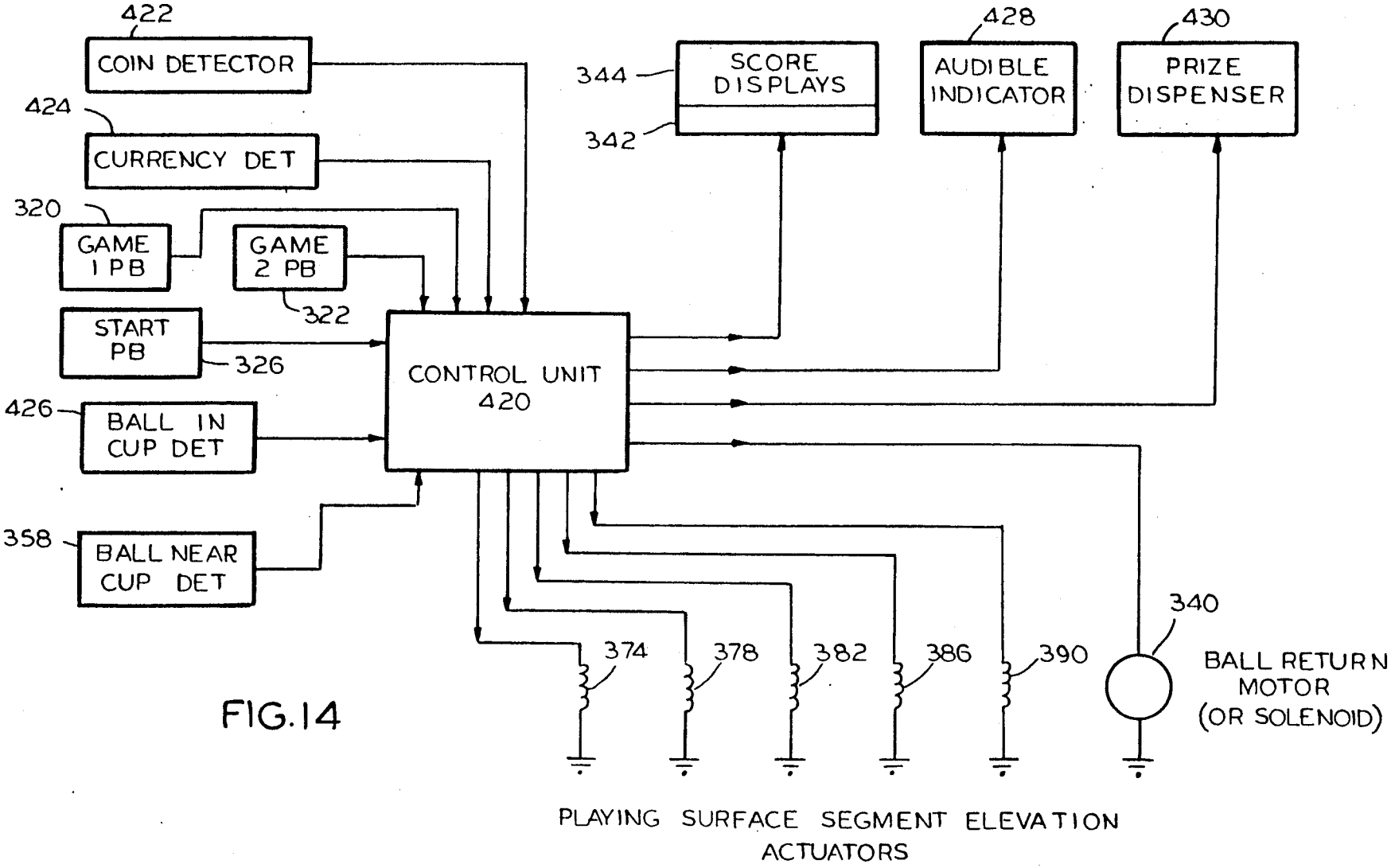
FIG. 14 is a block diagram of a control arrangement for a second embodiment for the putting green of FIGS. 10–14.

FIG. 14 shows a block diagram of a suitable control arrangement for the automated putting green 300 of FIGS. 10-14. A suitable control unit 420 is provided to sense the status of various components of the automated putting green 300, to control the score and information display 308, and to control the playing surface topography apparatus. Control unit 420 is preferably a microprocessor-based controller, but any suitable control means, such as discrete electronic logic, could be used. Such controllers are well known in the electronic arts. Control unit 420 may be located in score and information display 308 or control station 350, or another location in putting green 300 as appropriate.

Control unit 420 preferably receives a status signal from a coin detector 422 and a currency detector 424 so that it may determine whether the players have paid a requisite fee to commence a game. Control unit 420 also receives a status signal from each of push-buttons 320, 322, and 326, permitting players to select first and second preprogrammed "games" (i.e. combinations of particular topographies and scoring rules) and to request the commencement of a new game.

In addition control unit 420 preferably receives signals from ball location detector means 358 (FIG. 10) and 426, which respectively indicate that a ball has passed a predetermined location on the playing surface or that a ball has entered target hole 338. Detectors 358 and 426 may be implemented using any appropriate sensor, such as a mechanical switch, but are preferably optical detectors (such as as a photocells) which sense when a ball has interrupted a beam of light from an opposing emitter (not shown). Control unit 420 may use the information received from these detectors 358, 426 for ball counting purposes, for scoring, and to determine when excess balls on the playing surface should be collected. While two detector positions are described in this embodiment, additional detector positions may be desirable for additional scoring or control purposes.

Control unit 420 controls first and second score displays 342, 344 for first and second players respectively. Score displays 342, 344 may be any appropriate numeric or alpha-numeric displays, including mechanical, light emitting diode, neon, fluorescent, liquid-crystal or other displays capable of being controlled by control unit 420. Control unit 420 preferably also controls an audible indicator 428, such as a bell or speaker for providing appropriate sounds to accompany scoring events or to attract passers by. In addition, control unit 420 may also control a dispenser 430 for emitting prize tokens or other awards for players who achieve a score above or below a predetermined threshold.

Control unit 420 also controls playing surface segment . elevation actuators 374, 378, 382, 386, and 390 . Actuators 374, 378, 382, 386, and 390 may be solenoids, motors, or other appropriate electromechanical devices capable of being controlled by control unit 420 and capable of supporting the weight of respective segments of playing surface 302. In addition, control unit 420 controls the operation of automatic ball return means 340, which may be a a solenoid, motor, or other appropriate ball ejection means.

Control unit 420 is preferably adapted to selectably control putting green 300 according to one or more predefined "games" or combinations of particular topographies and scoring rules. For example, a first "game" might call for the putting green to deliver nine balls, one at a time, with the playing surface conforming to a different topography for each ball (i.e., for each ball, a different one of the topographies shown in FIG. 13 would be selected). The score would be calculated by counting the number of balls which reach the target hole 338. A second "game" might call for the putting green to deliver 18 balls, one at a time, randomly selecting a topogaphy for each ball. The final score would be calculated by assigning for each hole a score depending on whether the ball reached the hole 338, came near the hole 338, or fell down the ball return openings 354, and averaging all hole scores.

In the first embodiment, playing surface 12, slope elevation and multi-ball retrieval mechanism 14 and nylon members 16, 18, 20, 22 and 24 have not been described in terms of approximate measurements, as it should be understood that the size of the above-cited components may vary, but are limited to the manufacturing equipment's capabilities. This is also true of the second embodiment.

Therefore, it should be recognized that, while the invention has been described in relation to a first and second embodiment, those skilled in the art may develop a wide variation of structural details without departing from the principles of the invention. Therefore, the appended claims are to be construed to cover all equivalents falling within the true scope and spirit of the invention

The invention claimed is:

1. A putting green assembly, said assembly comprising a playing mat, a target hole in said playing mat, a means for adjusting the topography of said mat and for returning any balls on said mat to a predetermined location on said assembly, said means being adapted to elevate a predetermined segment of said playing mat and thereby adjust said topography of said mat by creating an incline therein, said incline also causing any balls on said predetermined segment to move away from said incline of said playing mat, control means for automatically operating said topography adjusting and ball return means, and detector means responsive to the presence of a ball on either said predetermined segment of said playing mat or in said target hole for signalling said control means to operate said topography adjusting and to operate said ball return means.

2. A putting green assembly, said assembly comprising a playing mat, said playing mat being fixed at an end and being movable at another end, said assembly further including at least one ball return opening adjacent said playing mat movable end and remote from said fixed end, means extending from said opening to said fixed end for returning balls entering said opening to said fixed end of said playing mat; a target hole in said playing mat remote from said fixed end; and a means for adjusting the topography of said playing mat and for returning a plurality of balls on said playing mat through said ball return opening to said fixed end of said mat, said adjusting means including a plurality of actuator that are selectively located at different locations beneath said playing mat for selectively elevating said playing mat and thereby adjusting said topography by creating a plurality of inclines therein, said inclines also causing balls on said playing mat remote from said fixed end to move towards said ball return opening of said mat wherein said plurality of balls are returned to said attached fixed end of said mat.

3. The putting green assembly of claim 2 further comprising control means for automatically operating said topography adjusting and ball return means, and first detection means responsive to the presence of at least one ball on said movable end of said playing mat for signalling said control means to operate said topography adjusting and ball return means.

4. The putting green assembly of claim 3 further comprising a second detector means responsive to the presence of at least one ball in said target hole for signalling said control means to operate said topography adjusting and ball return means.

* * * * *